US011292646B2

(12) United States Patent
Bai et al.

(10) Patent No.: US 11,292,646 B2
(45) Date of Patent: Apr. 5, 2022

(54) CONTAINER INCLUDING A REMOVABLE INTERLOCKING SEGMENT FOR A LID

(71) Applicant: WM. WRIGLEY JR. COMPANY, Chicago, IL (US)

(72) Inventors: Jingcheng Bai, Guangzhou (CN); Yali Cheng, Guangzhou (CN)

(73) Assignee: Wm. Wrigley Jr. Company, Chicago, IL (US)

( * ) Notice: Subject to any disclaimer, the term of this patent is extended or adjusted under 35 U.S.C. 154(b) by 27 days.

(21) Appl. No.: 16/474,627

(22) PCT Filed: Jan. 4, 2018

(86) PCT No.: PCT/US2018/012309
§ 371 (c)(1),
(2) Date: Jun. 28, 2019

(87) PCT Pub. No.: WO2018/129134
PCT Pub. Date: Jul. 12, 2018

(65) Prior Publication Data

US 2019/0367232 A1 Dec. 5, 2019

(30) Foreign Application Priority Data

Jan. 4, 2017 (CN) ..... 201710004008.9

(51) Int. Cl.
*B65D 55/06* (2006.01)
*B65D 43/16* (2006.01)
*B65D 85/60* (2006.01)

(52) U.S. Cl.
CPC ..... *B65D 55/06* (2013.01); *B65D 43/162* (2013.01); *B65D 85/60* (2013.01)

(58) Field of Classification Search
CPC ..... B65D 55/06; B65D 43/162; B65D 85/60
USPC ..... 220/270
See application file for complete search history.

(56) References Cited

U.S. PATENT DOCUMENTS 4,621,744 A * 11/1986 Foster ..... B65D 47/0847 220/214
5,201,440 A 4/1993 Gross
5,788,105 A * 8/1998 Foos ..... B65D 43/162 220/266
9,533,803 B1 * 1/2017 Giraud ..... B65D 50/06
2005/0279727 A1 * 12/2005 Graswald ..... B65D 55/06 215/237
2006/0011573 A1 1/2006 Herald
(Continued)

FOREIGN PATENT DOCUMENTS

CN 201553387 U 7/2009
GB 2490687 A 11/2012
(Continued)

*Primary Examiner* — J. Gregory Pickett
*Assistant Examiner* — Niki M Eloshway

(57) ABSTRACT

A container for storing a plurality of consumable goods includes a lid that includes a base and an upper portion hingedly coupled to the base. The container also includes an interlocking segment. The interlocking segment includes a removable strip coupled to an engagement strip at a frangible joint. The removable strip is coupled to the one of the base and the upper portion and the engagement strip is coupled to the other of the base and the upper portion. The removable strip is detachable at the frangible joint via manual actuation of the removable strip.

22 Claims, 6 Drawing Sheets

(56) References Cited

U.S. PATENT DOCUMENTS

| | | | | |
|---|---|---|---|---|
| 2012/0005994 | A1* | 1/2012 | Tidball | B65D 21/0233 53/484 |
| 2014/0209607 | A1* | 7/2014 | Fosse | B65D 43/162 220/270 |
| 2014/0312038 | A1 | 10/2014 | van Alfen et al. | |
| 2016/0304234 | A1* | 10/2016 | Herkenrath | B65D 33/12 |
| 2017/0203890 | A1* | 7/2017 | Lenz | B65D 51/26 |
| 2017/0283139 | A1* | 10/2017 | Fosse | B65D 55/06 |
| 2018/0093805 | A1* | 4/2018 | Tiesberger | B65D 50/045 |

FOREIGN PATENT DOCUMENTS

| | | | |
|---|---|---|---|
| WO | 9933713 | A1 | 7/1999 |
| WO | 2016022744 | A1 | 2/2016 |

* cited by examiner

CONTAINER INCLUDING A REMOVABLE INTERLOCKING SEGMENT FOR A LID

BACKGROUND

This disclosure relates generally to containers for storing and dispensing consumable products, and more specifically, to a container with an interlocking segment for a lid.

Packaging of such products keeps the products from being damaged during shipping, keeps the products fresh, and in certain instances, provides the consumer with a reusable package. In instances where a package includes a plurality product pieces and some but not all of the pieces may be consumed in one sitting, the manufacturer may wish to provide the consumer a container having a recloseable lid.

Consumers generally want to be sure that the consumable products they purchase are fresh, and/or that they have not been tampered with. A way to improve freshness and the safety of the product is by providing a visual cue that the packaging has not been opened or tampered with. Some manufactures provide for a wrapping, usually made of plastic, around the container to show that the product has not been opened. Such wrappings can cause the manufacturing cost of the product to increase.

BRIEF DESCRIPTION

In one aspect, a container for storing a plurality of consumable goods is provided. A lid comprising a base and an upper portion is hingedly coupled to said base. An interlocking segment comprising a removable strip is coupled to an engagement strip at a frangible joint. The removable strip is coupled to one of the base and the upper portion, and the engagement strip is coupled to the other of the base and the upper portion. The removable strip is detachable at said frangible joint via manual actuation of said removable strip.

In another aspect, a method of securing a lid of a container for storing a plurality of consumable goods is provided. The method includes coupling a removable strip of an interlocking segment to one of a base and an upper portion of the lid. The method further includes coupling an engagement strip of the interlocking segment to the other of the base and the upper portion of the lid, wherein the upper portion is hingedly coupled to the base and the removable strip is coupled to the engagement strip at a frangible joint, and wherein the removable strip is detachable at the frangible joint via manual actuation of the removable strip.

DETAILED DESCRIPTION

Figure 1:
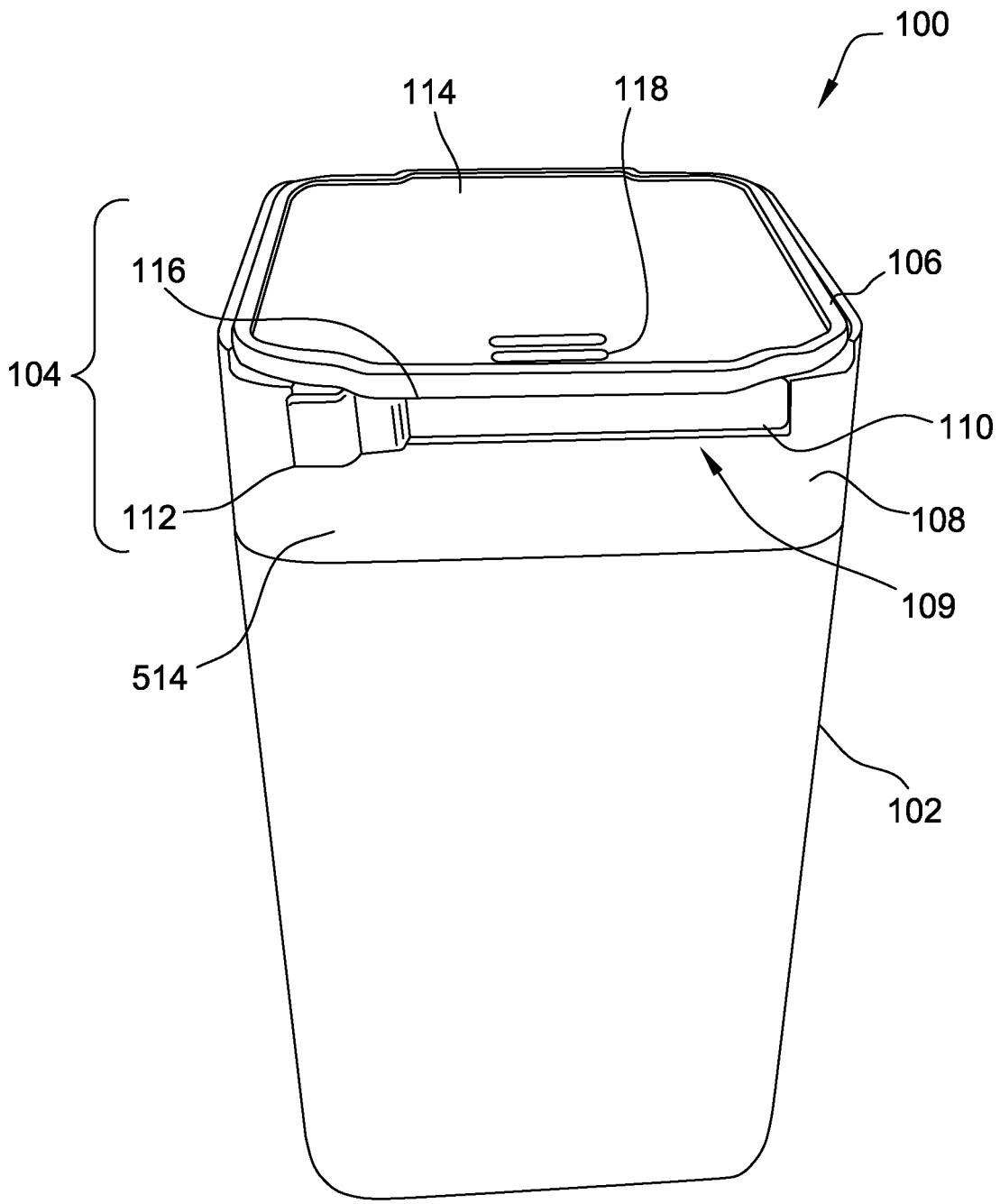
FIG. 1 is a perspective view of an example embodiment of a container including a removable interlocking segment for a lid.

The disclosure provides a container for consumable goods including an interlocking segment in a lid of the container. The interlocking segment is configured to attach to an upper portion of the lid and a base of the lid. In some arrangements, the base of the lid is integrally formed with a bottle or receptacle portion of the container. When coupled to the lid by way of an interlocking chamber of the lid, the interlocking segment keeps the container closed, effectively keeping the consumable products fresh and further indicates that the lid has not been opened for a first time after assembly. In some embodiments, the lid is recloseable after the lid has been opened for the first time.

It will be understood that various shapes and sizes of consumable products can be stored within the container. Examples of such shapes include pill, block, flat stick, pillow, round, rectangular, triangular, and any combination of the same. In an embodiment, the products housed in the container may be confectionery products, including such non-limiting examples as hard candies, gummy candies, mints, tablets, gum pellets, beads, liquid filled beads, chewy candy, chocolate, caramels, and gumballs. In another embodiment, the products may be snack foods, including such non-limiting examples as peanuts, nuts, pretzels, and salty snacks.

The products can alternatively be any other type of solid consumable product. For instance, the products can be cough drops or breath mints or other types of medical, consumable products. In an embodiment, the container may include combinations of products. It should also be appreciated that the container may house non-edible products of similar size and shape. The teachings of the present disclosure, however, are not dependent upon the products being any particular type as long as the products can fit within and be dispensed out of the product container described herein.

The container described herein includes a housing coupled to a lid for storing a plurality of consumable products. The housing may be any suitable size or shape, including but not limited to cubic, rectangular, pyramidal, cylindrical, conical, spherical, and combinations thereof. The housing further includes an opening for the placement and retrieval of the plurality of consumable products. The housing further includes, for example, but not by way of limitation, grooves on the end with the opening that fit with corresponding grooves included within the lid for coupling. In the example embodiment, the lid is formed as a separate piece from the housing. In another embodiment, the lid and the housing are formed as a unitary piece. The housing and lid are constructed from, but not limited to, plastic, metal, or any of various compounds or alloys thereof. In the example embodiment, as illustrated in the drawings, the housing and lid are made of a plastic.

In the example embodiment, as illustrated in the drawings, the lid is further configured to couple to the housing by way of a snap fit, wherein the lid is aligned with the housing and placed on the side of the housing with the housing opening. In another embodiment, the lid is configured to twist onto the housing, wherein an end of the housing portion and an end of the lid include grooves suitable for a twist fit.

The lid includes an upper portion, a connecting portion, and a base, wherein the upper portion is pivoted at the connecting portion relative to the base to open and close the lid. In the example embodiment, the upper portion includes a sealing member on a bottom surface of the upper portion. The base includes an opening, wherein the opening is sized to receive the sealing member in a close fit when the lid is closed. More specifically, the lid is configured so that the sealing member fits through the opening when the upper portion has pivoted into engagement with the base at the connecting portion.

When the upper portion is engaged with the base, the lid and the container are said to be in a closed configuration. In the closed configuration, the lid is coupled to the housing and the plurality of consumable goods cannot enter or leave the container. When the upper portion is not engaged with the base, the lid is said to be in an open configuration. This allows for the passage of the plurality of consumable goods from the housing through the lid.

The upper portion further includes a locking member on the bottom surface. The locking member is located on the bottom surface of the upper portion, near the front edge opposite the connecting portion, and extends from the bottom surface. The locking member is engageable with the interlocking segment. In some embodiments, the locking member is engageable with both the interlocking segment and the base of the lid.

In the example embodiment, the base of the lid includes an interlocking chamber defined therein. The interlocking chamber is located on a side of the base opposite the connecting member, and is configured to receive a portion of the interlocking segment.

The interlocking segment is configured to couple the upper portion of the lid to the base of the lid. This configuration maintains the closed configuration of the lid and acts as a visual indication to a consumer that the product has not been tampered with. It also serves to keep out excess air and other contaminants to keep the plurality of consumable goods fresh. In the example embodiment, the interlocking segment includes a removable strip coupled to an engagement strip. More specifically, the removable strip is coupled to the engagement strip at a frangible joint. In an embodiment, the removable strip and the engagement strip are manufactured as a unitary piece including the frangible joint, which may be, for example, a perforation, a score, a plurality of spaced tabs, or a continuous strip of material of reduced thickness relative to the engagement strip and removable strip.

In certain embodiments, the removable strip is coupleable to the upper portion. More specifically, the removable strip is configured to be retained by the upper portion, such as in a snap fit with the locking member and the bottom surface of the upper portion. Alternatively, the removable strip is formed unitarily with the upper portion of the lid. In addition, after the removable strip is coupled to the upper portion, the engagement strip is configured to be received within the interlocking chamber as the upper portion is pivoted into contact with the base. More specifically, the interlocking chamber is configured to retain the received engagement strip, such as in a snap fit. With the removable strip retained by the upper portion, the engagement strip retained in the interlocking chamber in the base of the lid, and the frangible joint intact, the upper portion is secured to the base. Moreover, the removable strip is exposed on the container, providing a visual indication that the lid has not been opened after the initial coupling with the interlocking segment.

The removable strip includes a grasping portion, located for example at one end of the removable strip that extends outward in such a way that a consumer can grab onto the grasping portion. The frangible joint is configured to be sufficiently strong to resist separation caused by normal shipping and handling conditions, but sufficiently weak to enable a consumer to purposefully tear the removable strip away from the engagement strip, and thus off the lid, using the grasping portion. In embodiments in which the removable strip is formed unitarily with the upper portion of the lid, an additional frangible joint may be provided between the removable strip and the upper portion.

Removing the removable strip allows the lid to move from the closed configuration to the open configuration, and allows retrieval of the consumables within the container. In the example embodiment, once the removable strip is removed, the engagement strip remains secured within the interlocking chamber of the lid, but does not interfere with further closing or opening of the lid.

In the example embodiment, the base of the lid further includes a reclosure lock that interfaces with the locking member to releasably couple the upper portion of the lid to the base. The reclosure lock functions in the absence of the removable strip, such that the lid may be securely re-closed and re-opened any number of times after the removal of the removable strip. For example, the locking member resiliently fits or snaps into a reclosure lock, such as a groove, when the lid is closed, so as to releasably hold the upper portion in place against the base, thereby retaining the closed configuration.

In some embodiments, the upper portion of the lid further includes a lip opposite the connecting portion. More specifically, the lip extends outward from the upper portion, such that the lip extends past the base when the lid is in the closed configuration. The lip facilitates disengaging the upper portion from the base.

FIG. 1 is a perspective view of an example embodiment of a container 100 including a housing 102 coupled to a lid 104. Lid 104 includes an upper portion 106 hingedly coupled to a base 108 by a connecting portion 500 (shown in FIG. 5). Upper portion 106 includes a top surface 114, and a lip 116 on a front edge opposite connecting portion 500. In the example embodiment, lip 116 projects outward past base 108. In alternative embodiments, lip 116 does not project outward past base 108. In other alternative embodiments, upper portion 106 does not include lip 116. In the example embodiment, top surface 114 further includes an alignment slot 118 defined proximate lip 116.

An interlocking segment 110 is coupled to lid 104. Interlocking segment 110 includes a removable strip 200 that includes a grasping portion 112 configured to enable a consumer to grasp grasping portion 112 and tear away removable strip 200 from container 100. In the example embodiment, a front top edge 109 of base 108 is recessed and sized to receive at least a portion of removable strip 200, such as portions other than grasping portion 112. Thus, removable strip 200, other than grasping portion 112, fits flush against a front surface 514 of base 108. In alternative embodiments, front top edge 109 of base 108 is other than recessed and/or no portion of removable strip 200 fits flush against front surface 514 of base 108.

Figure 2:
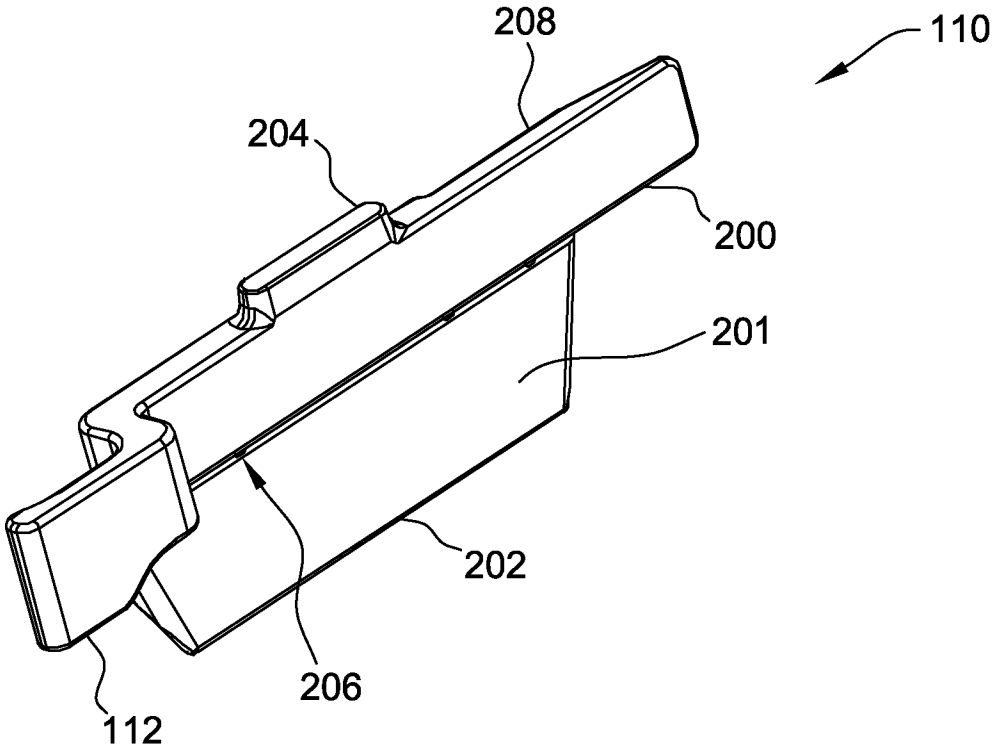
FIG. 2 is an illustration of a perspective view of the interlocking segment shown in FIG. 1, including a removable strip coupled to an engagement strip.
Figure 3:
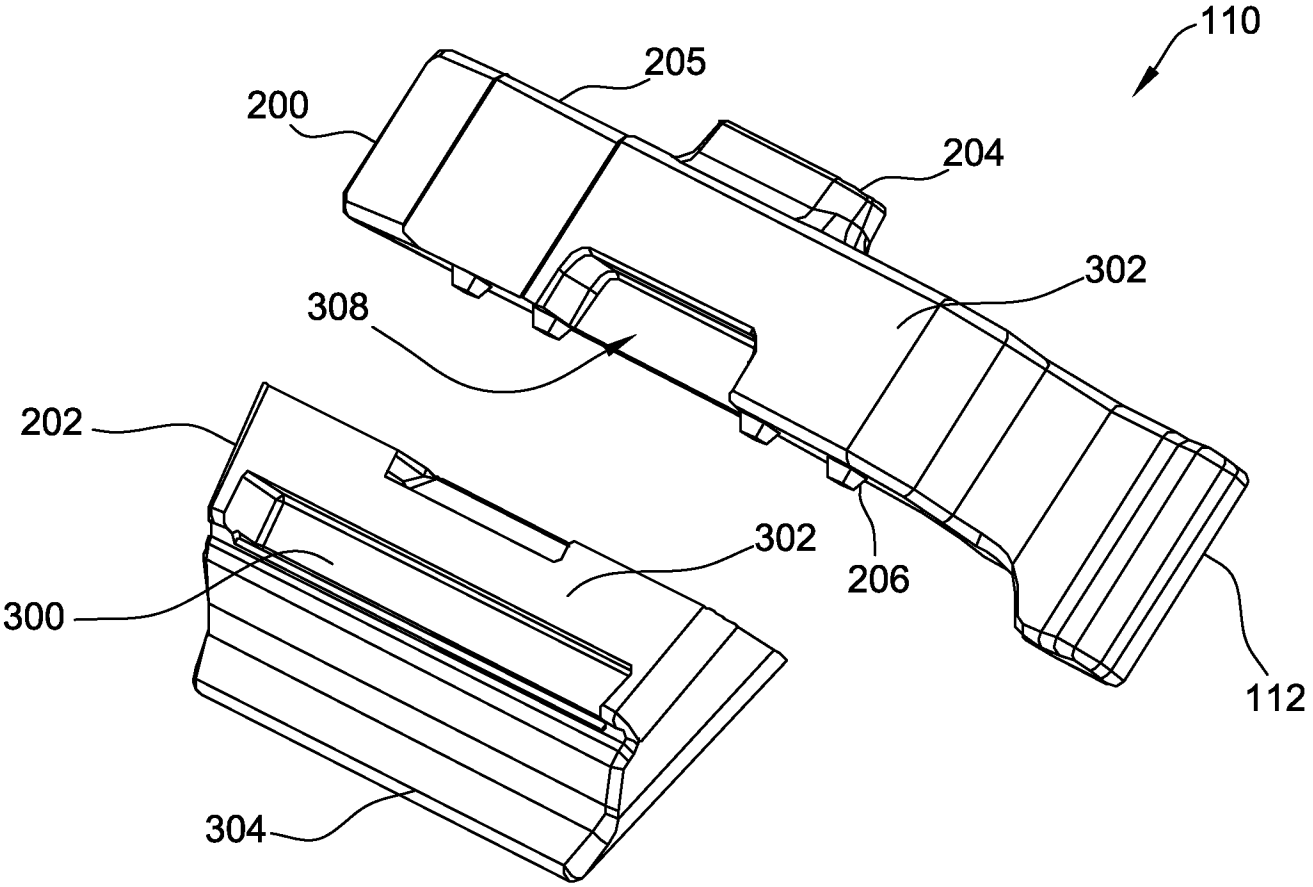
FIG. 3 is an illustration of a back perspective view of the interlocking segment shown in FIG. 2, wherein the removable strip and the engagement strip are detached from one another.
Figure 4:
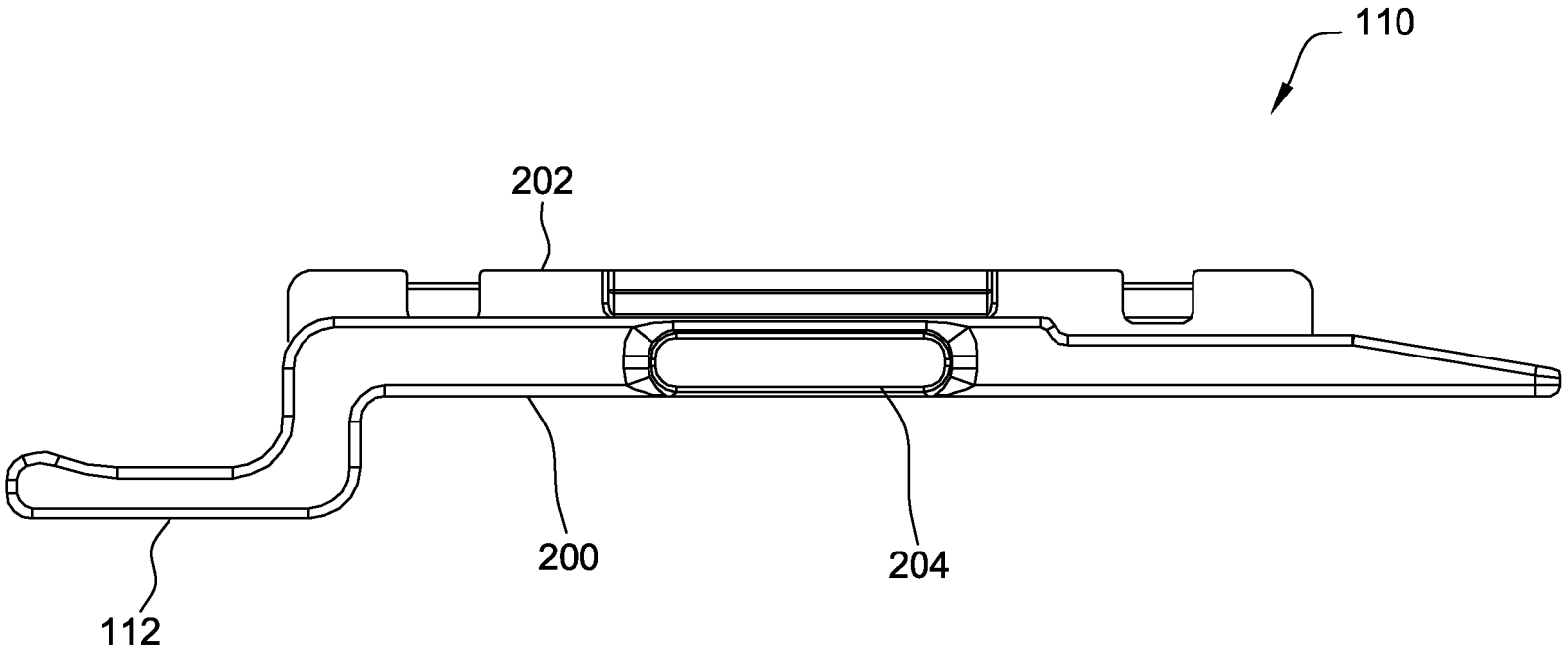
FIG. 4 is an illustration of a top view of the interlocking segment shown in FIG. 2.

FIG. 2 is an illustration of a front surface 201 of interlocking segment 110, including removable strip 200 coupled to an engagement strip 202 at a frangible joint 206. FIG. 3 is an illustration of a back surface 302 of interlocking segment 110, opposite front surface 201, wherein removable strip 200 and the engagement strip 202 are detached from one another at frangible joint 206. FIG. 4 is an illustration of a top view of the interlocking segment shown in FIG. 2.

With reference to FIGS. 1-4, engagement strip 202 is configured to fit into and be retained within base 108, as will be described herein. Frangible joint 206 is configured to be sufficiently strong to resist separation due to forces caused by normal shipping and handling conditions, but sufficiently weak to enable a consumer to purposefully remove removable strip 200 from engagement strip 202, and thus from lid 104, for example by pulling on grasping portion 112.

In the example embodiment, removable strip 200, engagement strip 202, and frangible joint 206 are integrally formed as a unitary piece. Frangible joint 206 includes a plurality of spaced tabs extending between removable strip 200 and engagement strip 202 to create the frangible joint. In alternative embodiments, frangible joint 206 is, for example, a perforation, a score, or a continuous strip of material of reduced thickness extending between engagement strip 202 and removable strip 200. In other alternative embodiments, removable strip 200 and engagement strip 202 are not formed unitarily. For example, frangible joint 206 includes at least one member formed integrally with one of removable strip 200 and engagement strip 202, and configured to lock in a corresponding opening defined in the other of removable strip 200 and engagement strip 202. Frangible joint 206 is sufficiently thin such that a small amount of, or no, space exists between adjacent edges of removable strip 200 and engagement strip 202.

When interlocking segment 110 is coupled to lid 104, back surface 302 of removable strip 200 faces front top edge 109 of base 108. In the example embodiment, removable strip 200 includes an alignment tab 204 configured to be received within upper portion alignment slot 118 to facilitate positioning interlocking segment 110 for coupling to upper portion 106, as will be described herein. In the example embodiment, slot 118 extends through upper portion 106. In alternative embodiments, slot 118 does not extend completely through upper portion 106. For example, alignment slot 118 is defined as an indentation in bottom surface 508. In other alternative embodiments, lid 104 does not include slot 118 and/or tab 204.

In the example embodiment, removable strip 200 further includes a lid locking feature 308 defined on back surface 302 and configured to couple to a locking member 506 (shown in FIG. 5) on lid upper portion 106, as will be described herein. Grasping portion 112 extends outward from removable strip 200 in a direction away from front surface 514 of base 108, so that a consumer may grab or grasp onto grasping portion 112 for the removal of removable strip 200 from engagement strip 202 at frangible joint 206.

Engagement strip 202 is configured to couple to, and be retained within, an interlocking chamber 510 (shown in FIG. 5) defined on base 108. In the example embodiment, back surface 302 of engagement strip 202 includes a first engagement locking feature 300 configured to couple to, and be retained by, a corresponding second engagement locking feature 520 (shown in FIG. 5) of base 108 when engagement strip 202 is inserted into interlocking chamber 510. In alternative embodiments, interlocking chamber 510 and engagement strip 202 are configured in any suitable fashion that enables engagement strip 202 to be retained within interlocking chamber 510. For example, but not by way of limitation, engagement strip 202 is configured to be retained within interlocking chamber 510 in a friction fit upon insertion.

Figure 5:
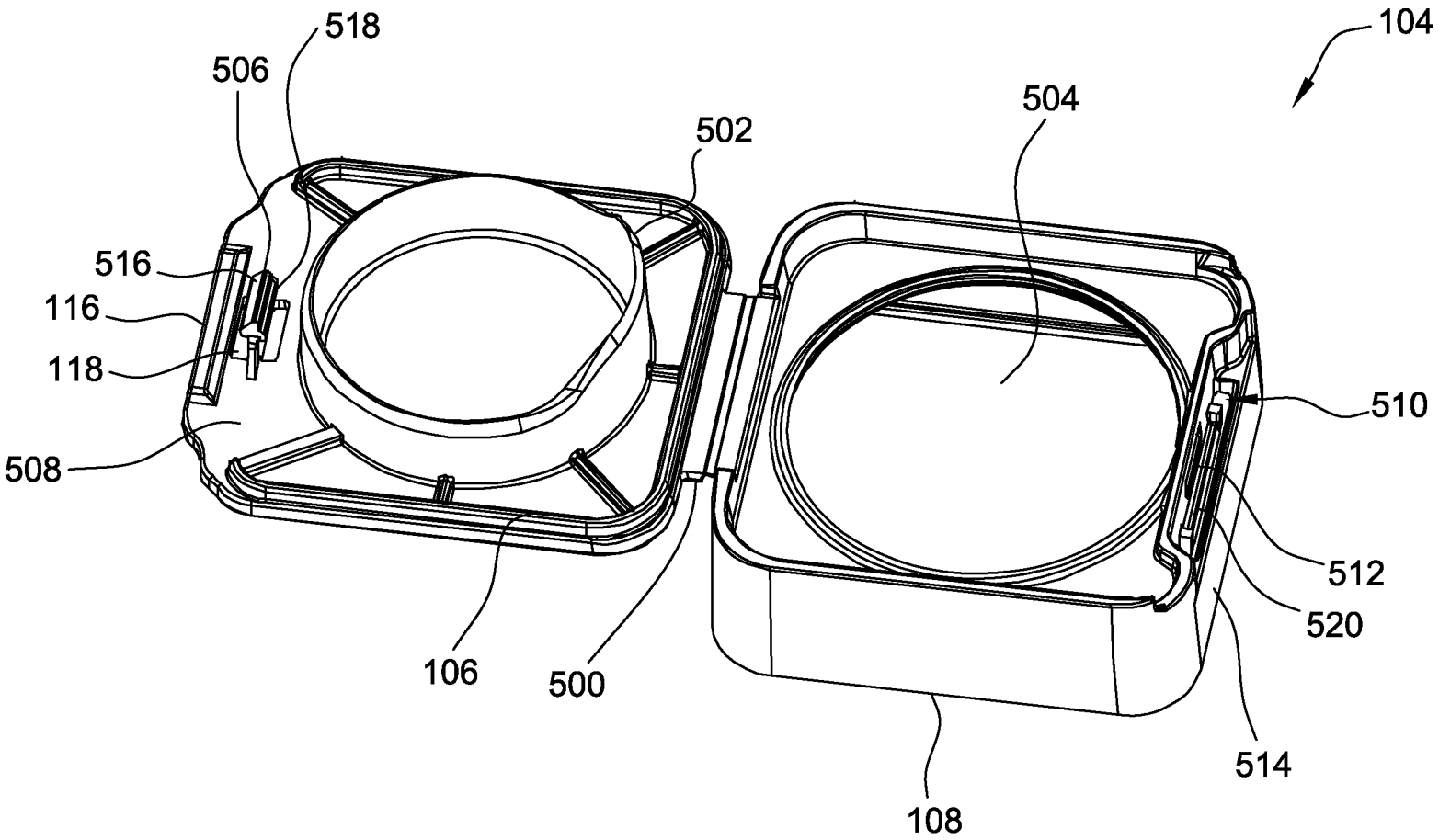
FIG. 5 is an illustration of a top perspective view of the lid shown in FIG. 1 having an example embodiment of an interlocking chamber and in an open configuration.
Figure 6:
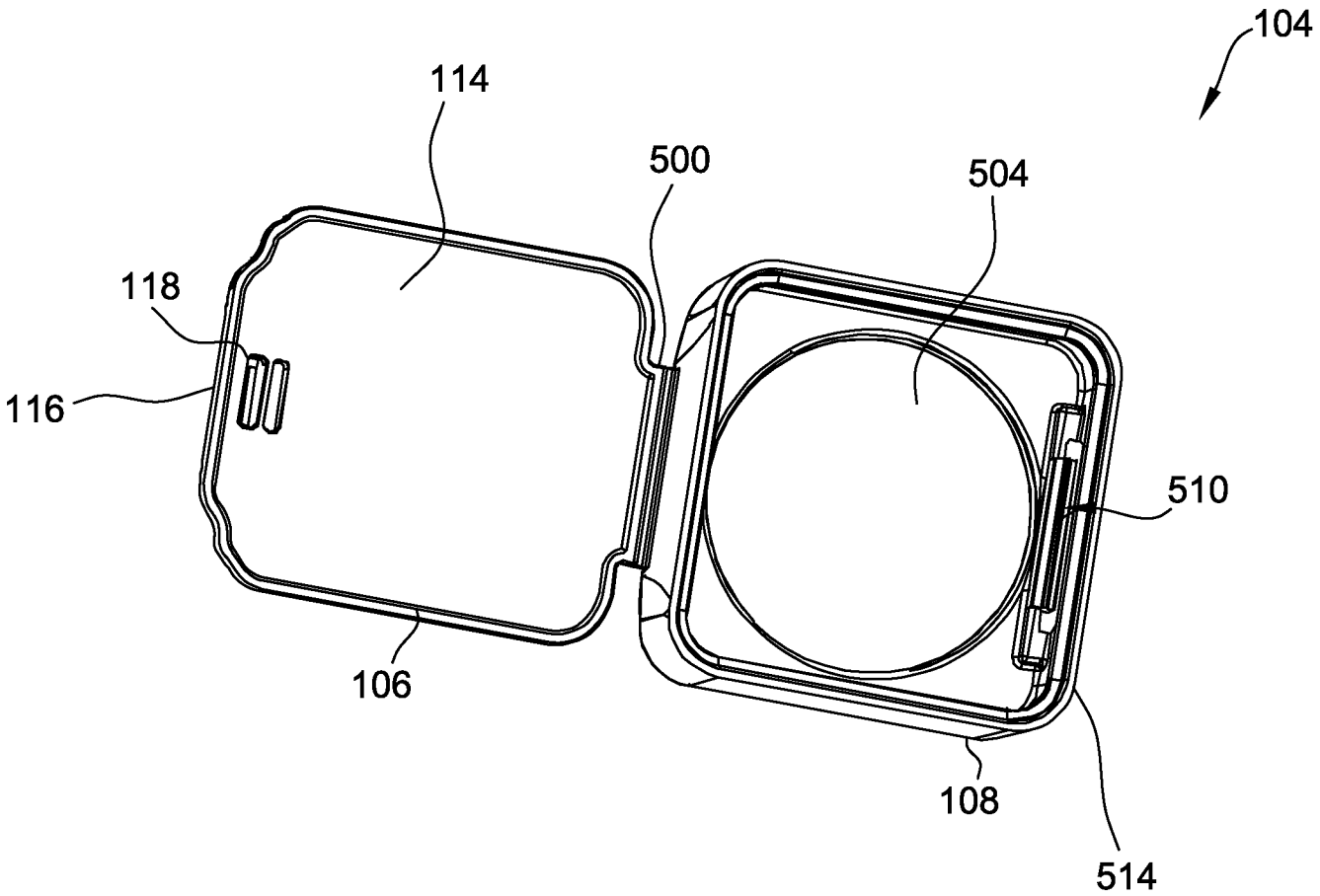
FIG. 6 is an illustration of a bottom perspective view of the lid shown in FIG. 1 having the interlocking chamber shown in FIG. 5.

FIG. 5 is an illustration of a top perspective view of lid 104 having interlocking chamber 510, with lid 104 in an open configuration. FIG. 6 is an illustration of a bottom perspective view of lid 104 and interlocking chamber 510. As noted above, connecting portion 500 hingedly couples upper portion 106 and base 108. Connecting portion 500 is formed in any suitable fashion that enables lid 104 to function as described herein.

In the example embodiment, upper portion 106 further includes a sealing member 502 coupled to and extending outwardly from a bottom surface 508 of upper portion 106. Base 108 further includes an opening 504 shaped to receive sealing member 502 when lid 104 is closed. Although sealing member 502 and opening 504 are illustrated in the example embodiment as having a circular shape, in alternative embodiments, sealing member 502 and opening 504 have any suitable shapes that enables sealing member 502 to fit into opening 504. In other alternative embodiments, lid 104 does not include sealing member 502.

Removable strip 200 is configured to couple to, and be retained by, upper portion 106. In the example embodiment, upper portion 106 includes locking member 506 configured to couple to removable strip 200. In the example embodiment, locking member 506 is a resiliently deformable member that extends outwardly from bottom surface 508, and includes a front tooth 516 extending from a front side thereof. Also in the example embodiment, lid locking feature 308 is defined as a groove in back surface 302 of removable strip 200. When interlocking segment 110 is positioned for coupling to lid 104, front tooth 516 is configured to couple to lid locking feature, or groove, 308, back surface 302 of removable strip 200 is configured to couple to locking member 506, and a top edge 205 of removable strip 200 is configured to couple to bottom surface 508, such as in a snap fit, such that interlocking segment 110 is retained by upper portion 106. In alternative embodiments, locking member 506 and removable strip 200 are configured to cooperate in any suitable fashion to enable upper portion 106 to retain removable strip 200. In other alternative embodiments, removable strip 200 is formed integrally with upper portion 106. For example, but not by way of limitation, upper edge 205 of removable strip 200 is coupled to bottom surface 508 of upper portion 106 at a second frangible joint (not shown).

In certain embodiments, interlocking chamber 510 is defined on base 108 below front top edge 109 of base 108, and behind front surface 514 of base 108. Interlocking chamber 510 is configured to receive engagement strip 202 therein, such that engagement strip 202 is retained by base 108, as described above. In the example embodiment, first engagement locking feature 300 is defined as a groove on back surface 302 of engagement strip 202, and second engagement locking feature 520 is defined as a projection extending within interlocking chamber 510 and configured to couple to first engagement locking feature 300, such as in a snap fit. In an alternative embodiment (not shown), first engagement locking feature 300 is defined as a projection extending from back surface 302 of engagement strip 202, and second engagement locking feature 520 is defined as a groove within interlocking chamber 510 and configured to couple to first engagement locking feature 300, such as in a snap fit. Additionally or alternatively, interlocking chamber 510 is configured to retain engagement strip 202 in any suitable fashion when interlocking chamber 510 receives engagement strip 202 therein, such as but not limited to by a friction fit between engagement strip 202 and interlocking chamber 510.

In the example embodiment, to install interlocking segment 110 on lid 104, interlocking segment 110 is oriented such that back surface 302 faces lid 104. Interlocking segment 110 is coupled to upper portion 106 by engagement of locking member 506 and removable strip 200. In some embodiments, alignment tab 204 is inserted into alignment slot 118 to facilitate alignment of removable strip 200 and locking member 506 for coupling. Locking member 506 resiliently engages lid locking feature 308 of removable strip 200, such that removable strip 200 is retained by upper portion 106. In addition, upper portion 106 is pivoted towards base 108 such that engagement strip 202 is received within interlocking chamber 510, and first engagement locking feature 300 and second engagement locking feature 520 couple together in a snap fit. With removable strip 200 retained by upper portion 104, engagement strip 202 retained in interlocking chamber 510 in base 108, and frangible joint 206 intact, upper portion 106 is secured to base 108. Moreover, removable strip 200 is exposed on container 100, providing a visual indication that lid 104 has not been opened after the initial coupling with interlocking segment 110.

After a consumer uncouples removable strip 200 from engagement strip 202 at frangible joint 206, for example by actuating removable strip 200 using grasping portion 112, upper portion 106 is openable. In the example embodiment, engagement strip 202 remains coupled within interlocking chamber 510 after opening, and does not interfere with further re-closing or re-opening of lid 104.

In certain embodiments, locking member 506 is further configured to couple to, and be retained by, base 108 after removal of removable strip 200. In the example embodiment, locking member 506 includes a back tooth 518 extending from a back side thereof, opposite the front side on which front tooth 516 is located. Moreover, front top edge 109 of base 108 includes a reclosure lock 512, such as a groove, defined therein. Back tooth 518 is configured to releasably couple to reclosure lock 512, such as in a snap fit, enabling upper portion 106 to be reclosed and reopened any number of times by the consumer after removal of removable strip 200. In alternative embodiments, lid 104 includes any suitable structure to enable upper portion 106 to be reclosed and reopened after initial removal of removable strip 200. In other alternative embodiments, upper portion 106 is not configured to be retained by base 108 after removal of removable strip 200.

Several embodiments of the present disclosure describe some features of the lid relating to the interlocking segment as being disposed on the upper portion of the lid and other, corresponding features being disposed on the base of the lid. However one of ordinary skill in the art would recognize that such features may be disposed on either the upper portion or the base of the lid in various arrangements. All such variants are contemplated within the scope of this disclosure.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

While certain exemplary embodiments have been described and shown in the accompanying drawings, it is to be understood that such embodiments are merely illustrative of and not restrictive on the broad disclosure, and that this disclosure not be limited to the specific constructions and arrangements shown and described, since various other modifications may occur to those ordinarily skilled in the art.

What is claimed is:

1. A container for storing a plurality of consumable goods comprising:

a base and an upper portion hingedly coupled to said base and defining an interior of the container for the plurality of consumable goods, wherein at least one of the base and the upper portion comprises an inner surface facing the interior of the container and a corresponding exterior facing outer surface opposite the inner surface; and an interlocking segment comprising a removable strip coupled to an engagement strip at a frangible joint, said removable strip coupled to one of the base and the upper portion, said engagement strip coupled to and retained between the inner surface and the outer surface of the other of the base and the upper portion, wherein said removable strip is detachable at said frangible joint via manual actuation of said removable strip.

2. The container according to claim 1, wherein the other of the base and the upper portion comprises an interlocking chamber defined therein and configured to receive said engagement strip.

3. The container according to claim 2, wherein said engagement strip comprises a first engagement locking feature defined thereon, said interlocking chamber comprises a corresponding second engagement locking feature configured to securely couple to said first engagement locking feature when said engagement strip is received in said interlocking chamber.

4. The container according to claim 3, wherein said first engagement locking feature comprises a groove defined on a back surface of said engagement strip, and said second engagement locking feature comprises a projection extending within said interlocking chamber and configured to couple to said first engagement locking feature.

5. The container according to claim 3, wherein said first engagement locking feature comprises a projection extending from a back surface of said engagement strip, and said second engagement locking feature comprises a groove defined within said interlocking chamber and configured to couple to said first engagement locking feature.

6. The container according to claim 2, wherein said engagement strip is configured to be received within said interlocking chamber in a friction fit.

7. The container according to claim 1, wherein said engagement strip is formed integrally with the other of the base and the upper portion.

8. The container according to claim 1, wherein the one of the base and the upper portion comprises a locking member configured to securely couple to said removable strip.

9. The container according to claim 8, wherein said removable strip comprises a lid locking feature defined on a back surface of said removable strip and configured to securely couple to said locking member.

10. The container according to claim 9, wherein said locking member comprises a resiliently deformable member that extends outwardly from a bottom surface of the one of the base and the upper portion.

11. The container according to claim 10, wherein said locking member comprises a front tooth extending from a front side thereof, said front tooth configured to couple to said lid locking feature.

12. The container according to claim 1, wherein said removable strip comprises an alignment tab receivable within an alignment slot defined on the one of the base and the upper portion.

13. The container according to claim 1, wherein a front top edge of the other of the base and the upper portion is recessed and sized to receive at least a portion of said removable strip.

14. The container according to claim 13, wherein said removable strip comprises a grasping portion that extends outward from a front surface of the other of the base and the upper portion.

15. The container according to claim 1, wherein said removable strip is formed integrally with the one of the base and the upper portion.

16. The container according to claim 1, wherein said removable strip, said engagement strip, and said frangible joint are integrally formed as a unitary piece.

17. The container according to claim 1, wherein said frangible joint comprises one of a plurality of spaced tabs, a perforation, a score, and a continuous strip of material of reduced thickness extending between said engagement strip and said removable strip.

18. A method of securing a lid of a container for storing a plurality of consumable goods, said method comprising:

coupling a removable strip of an interlocking segment to one of a base and an upper portion that define an interior of the container for the plurality of consumable goods, wherein at least one of the base and the upper portion comprises an inner surface facing the interior of the container and a corresponding exterior facing outer surface opposite the inner surface; and coupling an engagement strip of the interlocking segment to and retaining within the other of the base and the upper portion between the inner surface the outer surface, wherein the upper portion is hingedly coupled to the base and the removable strip is coupled to the engagement strip at a frangible joint, and wherein the removable strip is detachable at the frangible joint via manual actuation of the removable strip.

19. The method according to claim 18, wherein the one of the base and the upper portion includes a locking member extending therefrom, and wherein securely coupling the removable strip to the one of the base and the upper portion comprises securely coupling the locking member to the removable strip.

20. The method according to claim 18, wherein coupling the engagement strip to the other of the base and the upper portion comprises inserting the engagement strip into an interlocking chamber defined in the other of the base and the upper portion.

21. A container for storing a plurality of consumable goods comprising:

a lid comprising a base and an upper portion hingedly coupled to said base; and an interlocking segment comprising a removable strip coupled to an engagement strip at a frangible joint, said removable strip coupled to one of the base and the upper portion, said engagement strip coupled to the other of the base and the upper portion, wherein said removable strip is detachable at said frangible joint via manual actuation of said removable strip, wherein the one of the base and the upper portion comprises a locking member configured to securely couple to said removable strip, wherein said removable strip comprises a lid locking feature defined on a back surface of said removable strip and configured to securely couple to said locking member, wherein said locking member comprises a resiliently deformable member that extends outwardly from a bottom surface of the one of the base and the upper portion, and wherein said locking member comprises a front tooth extending from a front side thereof, said front tooth configured to couple to said lid locking feature.

22. A container for storing a plurality of consumable goods comprising:

a lid comprising a base and an upper portion hingedly coupled to said base; and an interlocking segment comprising a removable strip coupled to an engagement strip at a frangible joint, said removable strip coupled to one of the base and the upper portion, said engagement strip coupled to the other of the base and the upper portion, wherein said removable strip is detachable at said frangible joint via manual actuation of said removable strip, wherein said removable strip comprises an alignment tab receivable within an alignment slot defined on the one of the base and the upper portion.

* * * * *